United States Patent [19]

Payne et al.

[11] Patent Number: 4,947,304

[45] Date of Patent: Aug. 7, 1990

[54] UNDERWATER LAMP HAVING WATERTIGHT ELECTRICAL CONNECTION

[75] Inventors: Thomas B. Payne; Ernest M. Schmidt, both of Salina, Kans.

[73] Assignee: UTE Corp, Salina, Kans.

[21] Appl. No.: 377,620

[22] Filed: Jul. 10, 1989

[51] Int. Cl.[5] ..... F21V 31/00

[52] U.S. Cl. ..... 362/267; 43/175

[58] Field of Search ..... 362/267, 158, 362, 253; 43/17.5

[56] References Cited

U.S. PATENT DOCUMENTS

| | | | |
|---|---|---|---|
| 1,192,001 | 7/1916 | Rvan . | |
| 1,663,465 | 3/1928 | Neff . | |
| 1,804,084 | 5/1931 | Blake | 43/17.5 |
| 2,364,787 | 12/1944 | Harrison et al. . | |
| 2,777,942 | 1/1957 | Lester | 362/267 |
| 2,864,195 | 10/1957 | Bachmann . | |
| 3,464,139 | 10/1969 | Eggers . | |
| 3,474,243 | 10/1969 | Miller | 367/267 |
| 3,500,037 | 3/1970 | Starck II . | |
| 3,502,861 | 3/1970 | Evans . | |
| 3,510,978 | 5/1970 | Murdock | 43/17.5 |
| 3,617,733 | 11/1971 | Adams . | |
| 3,652,846 | 3/1972 | Starck . | |
| 3,680,245 | 8/1972 | Brooks . | |
| 3,720,824 | 3/1973 | Callahan . | |
| 3,798,822 | 3/1974 | Lampus . | |
| 3,852,587 | 12/1974 | Koehler . | |
| 3,949,212 | 4/1976 | Larrimore . | |
| 4,053,758 | 10/1977 | Shaw . | |
| 4,190,976 | 3/1980 | Hurt . | |
| 4,344,118 | 8/1982 | Rundquist et al. . | |
| 4,429,350 | 1/1984 | Guthrie . | |
| 4,499,527 | 2/1985 | Tauber et al. . | |
| 4,531,178 | 7/1985 | Uke . | |
| 4,683,523 | 7/1987 | Olsson et al. . | |

FOREIGN PATENT DOCUMENTS

| | | |
|---|---|---|
| 780725 | 3/1968 | Canada . |

*Primary Examiner*—Ira S. Lazarus
*Assistant Examiner*—Richard R. Cole
*Attorney, Agent, or Firm*—Hovey, Williams, Timmons & Collins

[57] ABSTRACT

An underwater lighting apparatus includes a lamp having a filament, an envelope surrounding the filament, and a pair of contacts extending through the envelope, and a wiring arrangement for electrically connecting the contacts to a source of electrical power. The wiring arrangement includes a socket assembly on which the lamp is removably retained through a friction fit connection between the contacts of the lamp and a pair of terminals of the socket assembly and includes a transparent casing having an open axial end and a closure member retained in the open axial end. The closure member may be removed from the open axial end of the casing to permit replacement of the lamp in the socket assembly.

15 Claims, 1 Drawing Sheet

UNDERWATER LAMP HAVING WATERTIGHT ELECTRICAL CONNECTION

BACKGROUND OF THE INVENTION

1. Field of the Invention

The present invention relates generally to lighting devices and, more particularly, to a lighting apparatus having a watertight electrical connection which permits use of the apparatus underwater, and a lamp mounting structure which permits replacement of lamps used in the apparatus. The invention also relates to a method of making an underwater lighting apparatus have a watertight electrical connection and a lamp mounting structure which permits lamp replacement.

2. Discussion of the Prior Art

In U.S. Pat. No. 3,652,846, to Starck, II, an underwater hand light is illustrated which includes a light source adapted to be slidably positioned relative to a co-operating reflector and constructed to be independently used separate from the reflector. The light source in this patent includes a quartz-iodide type bulb which is connected to a battery through a cable extending through the interior of a hollow socket member. An outer light-transmitting shielding tube is frictionally held on the socket member by a resilient ring, and the socket, bulb and bulb shielding tube form a unitary assembly which is movable within the housing of the apparatus relative to the reflector.

Another device illustrated in U.S. Pat. No. 3,652,846, relates to a combination of a quartz-iodide type bulb having a co-operating outer shielding tube formed as a single unit which can be used for general uses either in or out of underwater environments. In accordance with the disclosure of this device, the outer shielding tube may be threaded for mating engagement with co-operating threads on a base or socket of the bulb to permit the two parts to be assembled into a single unit, and the base or socket may be provided with outer threads to permit the entire unit to be screwed into a source of electricity.

OBJECTS AND SUMMARY OF THE INVENTION

It is an object of the present invention to provide an underwater lighting apparatus which is designed for independent use and which is constructed in a manner permitting the replacement of a burnt out lamp or the substitution of lamps having different output values.

In accordance with the invention, an underwater lighting apparatus comprises a lamp having a filament, an envelope surrounding the filament, and a pair of contacts extending through the envelope, and electrical connection means for electrically connecting the contacts to a source of electrical power, the electrical connection means including a socket assembly having a pair of terminals, and means for removably retaining the lamp on the socket assembly with the contacts disposed in surface contact with the terminals. In addition, a water-tight enclosure is provided which surrounds the lamp and the socket assembly. This enclosure includes a transparent casing having an open axial end, a closure member retained in the open axial end, and means for removing the closure member from the open axial end of the casing to permit replacement of the lamp in the socket assembly.

Preferably, each of the contacts of the lamp is a pin formed of an electrically conductive material and each of the terminals includes a hole lined with electrically conductive material shaped to engage the pins in a friction fit relation when the pins are inserted into the holes. In addition, the apparatus further comprises a ballast assembly including a hollow ballast member extending between the closure member and the socket assembly, and securing means for securing the ballast member between the socket assembly and closure member and for isolating the insulated wires from one another and securing the insulated wires within the ballast member, the securing means including a sealant material which surrounds the insulated wires within the ballast member and which bears against the socket assembly and the closure member so as to seal the socket assembly, the insulated wires and the closure member from exposure to water.

A method of constructing an underwater lighting apparatus in accordance with the invention comprises the steps of connecting a pair of insulated wires to a pair of terminals of a socket assembly adapted to removably receive a pair of contacts of a lamp, threading the pair of insulated wires through a hollow ballast member and a closure member, and injecting a sealant material into the hollow ballast member, the sealant material insulating the wires from one another within the hollow ballast member. The further steps of securing the socket assembly and the closure member to the ballast member and providing a watertight sleeve around the socket assembly, closure member and ballast member to form a lamp assembly are also included in the method, as well as the step of inserting the lamp assembly into an open axial end of a transparent watertight casing, the closure member being formed of a shape corresponding to the shape of the open axial end of the casing, the closure member being removably retained in the open axial end of the casing through a watertight frictional engagement between the closure member and the casing.

BRIEF DESCRIPTION OF THE DRAWING FIGURES

A preferred embodiment of the invention is discussed in detail below with reference to the attached drawing figures, wherein.

DETAILED DESCRIPTION OF THE PREFERRED EMBODIMENT

Figure 1:
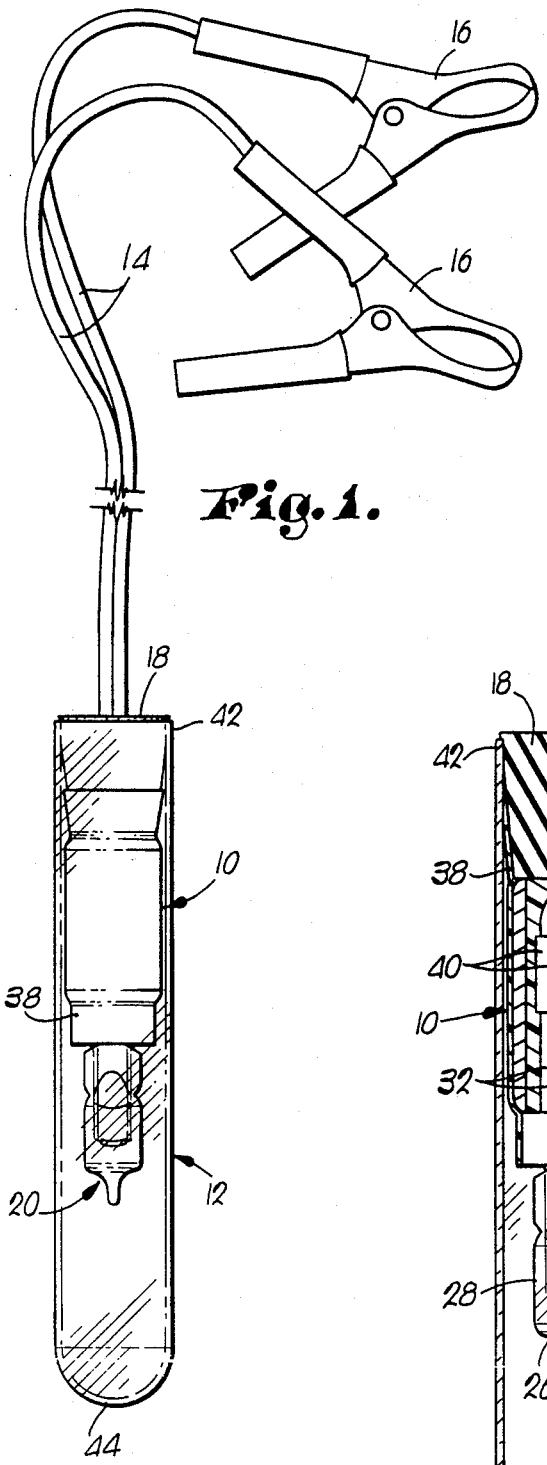
FIG. 1 is a side elevation view of an underwater lighting apparatus constructed in accordance with the invention.

A preferred embodiment of an underwater lighting apparatus constructed in accordance with the present invention is illustrated in FIG. 1. The apparatus generally includes a lighting assembly 10, a transparent casing 12 providing a watertight enclosure for the lighting assembly, a pair of insulated conductive wires 14 extending from the lighting assembly, and a pair of clamps 16 attached to the ends of the wires 14 and being adapted to be clipped to the terminals of a battery of a conventional type.

By constructing the lighting apparatus in accordance with the embodiment illustrated in FIG. 1, the inventive apparatus finds particular utility as a fishing light. The clamps 16, which are soldered or otherwise held at the ends of the insulated wires 14, may be clipped to the posts of a battery, such as a 12 Volt battery commonly available on fishing boats. In this manner, electricity is made available to the lighting assembly 10, which is retined in an enclosure defined by the transparent watertight casing 12 and a closure member 18 retained on the lighting assembly 10. Thus, the lighting assembly may be lowered over the side of the boat into a body of water in order to attract fish to the area in which light is transmitted.

Briefly, the principle on which the use of lighting devices as fishing aids is based, is that the light emitted by a lighting device in the water attracts plankton and the like which in turn attracts bait fish such as minnows. As a result of the increased minnow and bait fish population, larger fish, such as sporting fish, are then attracted to the area and may be caught by fishermen fishing in or near the illuminated area.

One problem which has been encountered since lighting devices have been in use in fishing operations resides in the variations which naturally occur in the clarity of water in which such lighting devices are used. Because light is transmitted further in clear water than in murky water, less output is required when the lighting device is being used in clear water, while more light output would be desired when the lighting device is to be used in murky or muddy water. Although not an exact science, it has been found that it is possible to provide either too little or too much light to an area, and it is an object of the present invention to provide an apparatus which permits the replacement of one lamp having a first output with a second lamp having any other desired output in order to increase the utility of the apparatus.

Figure 2:
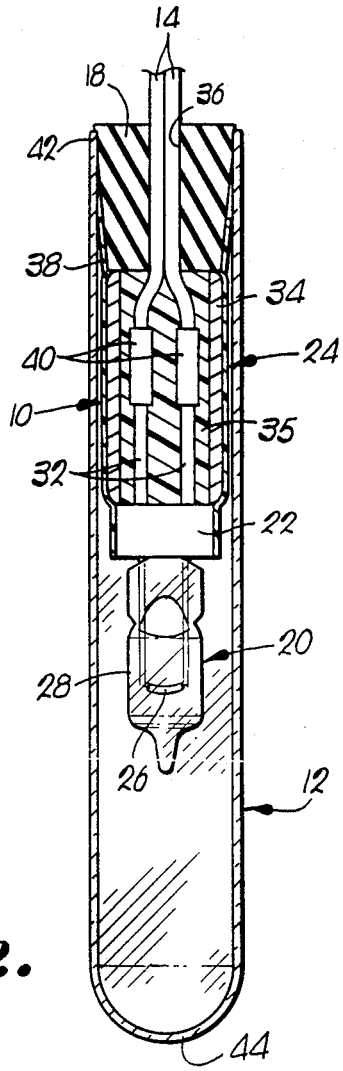
FIG. 2 is a side sectional view of the lighting apparatus shown in FIG. 1.

This feature of permitting the replacement of lamps in the underwater lighting device exists in the present invention, and the preferred embodiment of the lighting assembly and casing used to achieve this feature of the invention is illustrated in detail in FIG. 2. As shown in this figure, the lighting assembly 10 includes a lamp 20, a socket 22, a ballast assembly 24, and the closure member or stopper 18.

The lamp 20 is preferably a halogen lamp having an output of anywhere from about 20 Watts to over 100 Watts, and includes a filament 26, an envelope 28 formed of hardened glass or quartz, and a pin base including a pair of pin contacts 30. However, it is possible to employ any desired type of lamp in the lighting apparatus in order to achieve a desired lighting effect. For example, if low output is desired in a particular application of the invention, a regular filament lamp could be inserted into the apparatus, whereas, if a higher output is necessary, a halogen, tungsten, krypton or halide type lamp, or any other conventional type of lamp, could be attached to the socket.

Preferably, the socket 22, which is a conventional element, includes a heat resistant body having front and rear surfaces and a pair of insulated conductive wires 32 extending from the rear surface. A pair of holes are provided in the front surface of the socket which are spaced apart by a distance equal to the spacing between the pin contacts 30 of the lamp in order that the pins may be received in the holes. Electrically conductive terminals are provided within the holes and make friction fit surface contact with the pins 30 when the pins are inserted in the holes. However, the terminals are not permanently connected to the pins and the pins may be easily removed from the terminals by simply pulling the lamp 20 from the socket 22, thus overcoming the friction fit between the pins and the terminals.

Adjacent the rear surface of the socket, the ballast assembly 24 is provided. This assembly includes an outer hollow ballast member 34 and an inner filling 25 of a sealant material used to isolate the wires 14, 32 within the ballast member 34 and to add further ballast to the apparatus. In addition, the sealant material serves as an adhesive which holds the ballast assembly 24, socket 22 and closure member 18 together once assembled. Additional ballast material may be added to the sealant material to increase the weight of the apparatus without increasing its size. For example, lead pellets may be added to the sealant material when it is injected into the ballast member in order to add weight to the apparatus.

The closure member 18 preferably includes a rubber stopper having a central longitudinal hole 36 passing therethrough and a tapered outer surface. The hole 36 is adapted to receive the wires 14 and the tapered outer surface engages the casing 12 in order to hold the lighting assembly 10 in the casing and to provide a watertight seal between the lighting assembly and the casing. An outer sleeve 38 of sealant material may also be provided which surrounds the peripheral surfaces of the socket 22, ballast member 34 and closure member 18, and which further seals the lighting assembly 10 against leakage of water and helps to hold the lighting assembly together once assembled. Similar sealant material may be provided around the soldered connections between the wires 14, 32 to ensure that the wires do not contact one another and are not exposed to water during underwater use of the apparatus.

Figure 3:
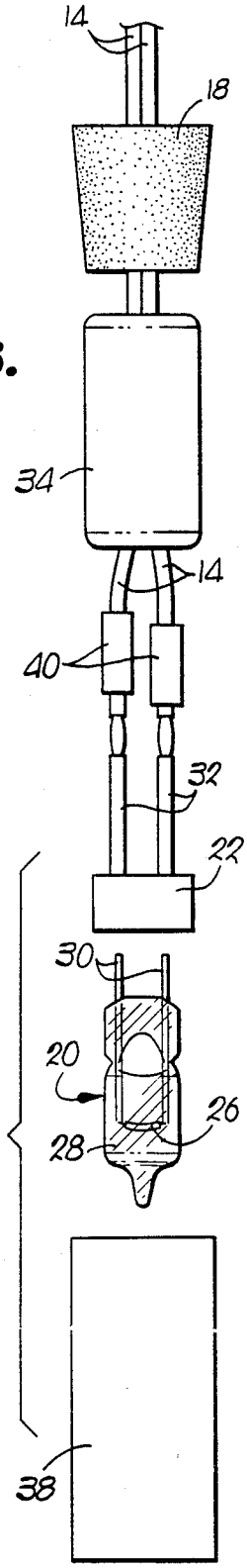
FIG. 3 is an exploded view of the lighting apparatus illustrated in FIG. 1, illustrating the matter in which the apparatus is assembled.

The manner in which the apparatus is constructed is discussed with reference to FIG. 3. The wires 14 are preferably threaded through the closure member 18 and the hollow ballast member 34, and each of the wires is threaded through a sleeve 40 of shrink fit sealant material of any conventional type. Thereafter, the wires 14 are soldered to the ends of the wires 32 extending from the rear surface of the socket 22, the sleeves 40 are slid along the wires to a position covering the soldered connections, and the assembly is subjected to a temperature sufficient to cause the sleeves 40 to shrink around the wires 14, 32 to seal the connections In addition to providing an electrical connection between the lamp 20 and the source of electrical power, the insulated wires also serve as a pull cord by which the lighting assembly 10 may be pulled from the casing 12 when such removal of the assembly is desired. Thus, the soldered connection is advantageous in that it is stronger than other types of connections and permits large tensile forces to be exerted on the wires 14, 32 without breakage.

Once the sleeves 40 have been shrunk, the ballast member 34 is positioned in close proximity to the rear surface of the socket 22 and a sealant material, such as silicone rubber, is poured or otherwise injected into the hollow interior of the ballast member. This sealant material flows around the wires 14, 32 to isolate the wires from one another, and fills the regions adjacent the rear surface of the socket 22 in order to secure the socket to the ballast member 34. Once the ballast member has been filled with sealant material, but before the sealant material has dried, the closure member 18 is brought into contact with the upper surface of the ballast member so that the closure member is also retained on the ballast member by the sealant material.

The next step in constructing the preferred lighting apparatus includes positioning the heatshrink sleeve 38 of sealant material around the lighting assembly 10 defined by the socket 22, ballast assembly 24 and closure member 18, and heating the assembly to cause the sleeve 38 to shrink to a size closely fitting around the assembly. This sleeve 38 of sealant material helps hold the lighting assembly together and prevents water from getting into the lighting assembly.

Once assembled, the lighting assembly 10 is fitted with a lamp 20 having a desired output level, and the lighting assembly is positioned in the casing 12 by inserting the assembly 10, lamp first, into an open end 42 of the casing 12 until the closure member 18 engages the inner peripheral surface of the open end of the casing. The connection formed between the closure member 18 and the open end 42 of the casing 12 is a friction fit connection which provides a watertight seal for preventing exposure of the lamp 20 or socket 22 to water, and which is removable in order to permit replacement of the lamp 20 whenever desired.

The casing 12 is preferably formed of a hardened glass or quartz material and may include a material known and marketed under the trademark "PYREX", or may include any other transparent material capable of withstanding temperatures of about 200 degrees Celsius or more. Although the shape of the casing is not critical, it is preferred that the casing have a tubular shape with an open end 42 and a closed end 44, wherein the closed end 44 is rounded to define a lens-like end piece which directs light in the longitudinal directed of the tubular casing so as to provide an advantageous lighting of the underwater region beneath the lighting apparatus when in use.

Although the apparatus of the preferred embodiment has been illustrated independently of any support device, it is understood that the apparatus of the invention could be employed in connection with such devices. For example, although described as an apparatus useful in fishing, the device could be used as a lighting apparatus for illuminating any underwater areas, such as swimming or docking areas, where it is desired that underwater visibility be increased. In such applications, the apparatus could be provided with a float which supports the apparatus adjacent the surface of the water and which orients the apparatus with the closed end of the casing pointing downward so that the maximum amount of light possible is being directed into the water.

Such a float could include a donut flotation element extending around the casing adjacent the open end thereof, which element could also include a cage or shield surrounding the casing in order to prevent swimmers from contacting the casing.

Thus, although the invention has been illustrated and disclosed with reference to the preferred embodiment, it is understood that substitutions may be made and equivalents employed herein, without departing from the scope of the invention as set forth in the claims.

What is claimed is:

1. An underwater lighting apparatus comprising:

a lamp having a filament, an envelope surrounding the filament, and a pair of contacts extending through the envelope;

electrical connection means for electrically connecting the contacts to a source of electrical power, the electrical connection means including a socket assembly provided with a base having a pair of terminals, the base including a front surface on which the lamp is adapted to be retained and a rear surface opposite the front surface, means for removably retaining the lamp on the front surface of the socket assembly with the contacts disposed in surface contact with the terminals, and a pair of insulated wires extending from the rear surface of the socket assembly;

a watertight enclosure surrounding the lamp and the socket assembly, the enclosure including a transparent casing having an open axial end, a closure member retained in the open axial end, and means for removing the closure member from the open axial end of the casing to permit replacement of the lamp in the socket assembly;

a ballast assembly including a hollow ballast member extending between the closure member and the socket assembly; and a watertight sleeve extending between the front surface of the socket assembly and the closure member, the pair of insulated wires passing within the watertight sleeve from the socket assembly through the closure member.

2. The underwater lighting apparatus as recited in claim 1 further comprising securing means for securing the socket assembly on the ballast member and for isolating the insulated wires from one another and securing the insulated wires within the ballast member, the securing means including a sealant material which surrounds the insulated wires within the ballast member and which bears against the rear surface of the socket assembly so as to seal the rear surface of the socket assembly and the insulated wires within the ballast member from exposure to water when the apparatus is submerged underwater.

3. The underwater lighting apparatus as recited in claim 1, wherein the closure member is formed at least partially of a compressible material and is of a shape corresponding to the open axial end of the casing, the closure member being retained in the open axial end of the casing through a watertight frictional engagement between the closure member and the casing.

4. The underwater lighting apparatus as recited in claim 3, the apparatus further comprising securing means for securing the ballast member between the socket assembly and closure member and for isolating the insulated wires from one another and securing the insulated wires within the ballast member, the securing means including a sealant material which surrounds the insulated wires within the ballast member and which bears against the socket assembly and the closure member so as to seal the socket assembly, the insulated wires and the closure member from exposure to water.

5. The underwater lighting apparatus as recited in claim 3, wherein the closure member is a rubber stopper having a tapered outer peripheral surface and an axial opening extending therethrough.

6. The underwater lighting apparatus as recited in claim 1, wherein the transparent casing extends in an axial direction and includes a closed axial end opposite the open axial end, the closed axial end defining a light directing lens which directs light from the lamp in the axial direction of the casing.

7. The underwater lighting apparatus as recited in claim 1, wherein the electrical connection means includes a pair of electrically conductive clamps adapted to be removably connected to the source of electrical power, and a pair of insulated wires extending between the socket assembly and the conductive clamps.

8. The underwater lighting apparatus as recited in claim 1, wherein the lamp is a halogen lamp.

9. The underwater lighting apparatus as recited in claim 1, wherein each of the contacts is a pin formed of an electrically conductive material and each of the terminals includes a hole lined with electrically conductive material shaped to engage the pins in a friction fit relation when the pins are inserted into the holes.

10. A method of constructing an underwater lighting apparatus comprising the steps of:

connecting a pair of insulated wires to a pair of terminals of a socket assembly adapted to removably receive a pair of contacts of a lamp;

threading the pair of insulated wires through a hollow ballast member and a closure member;

securing the socket assembly and the closure member to the ballast member and providing a watertight sleeve around the socket assembly, closure member and ballast member to form a lamp assembly; and inserting the lamp assembly into an open axial end of a transparent watertight casing, the closure member being formed of a shape corresponding to the shape of the open axial end of the casing, the closure member being removably retained in the open axial end of the casing through a watertight frictional engagement between the closure member and the casing.

11. The method as recited in claim 10, further comprising the step of attaching an electrically conductive clamp to an end of each of the insulated wires.

12. The method as recited in claim 10, wherein the step of providing a watertight sleeve around the socket assembly, closure member and ballast member includes positioning a sleeve of heat-shrinkable material around the socket assembly, closure member and ballast member and subjecting the sleeve to a temperature sufficient to cause the material to shrink to a size providing watertight sealing engagement between the sleeve and the socket assembly, closure member and ballast member 13. The method as recited in claim 10, further comprising the step of removably positioning the pair of contacts of the lamp in surface contact with a pair of terminals provided in the socket assemblY, each of the terminals being in electrical engagement with one of the insulated wires.

14. The method as recited in claim 13, further comprising the step of replacing the lamp in the apparatus by removing the lamp assembly from the transparent watertight casing and detaching the pair of contacts of the lamp from surface contact with the terminals provided in the socket assembly.

15. The method as recited in claim 13, wherein the contacts are pins and the terminals are provided with holes shaped to receive the pins, and wherein the step of removably positioning the pair of contacts of the lamp in surface contact with a pair of terminals provided in the socket assembly includes pushing the pins into the holes of the terminals.

* * * * *